US011946014B2

(12) United States Patent
Kaneko

(10) Patent No.: US 11,946,014 B2
(45) Date of Patent: Apr. 2, 2024

(54) WATER/GLYCOL-BASED HYDRAULIC FLUID

(71) Applicant: SHELL USA, INC., Houston, TX (US)

(72) Inventor: Hiroshi Kaneko, Tokyo (JP)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/910,877

(22) PCT Filed: Apr. 1, 2021

(86) PCT No.: PCT/EP2021/058615
§ 371 (c)(1),
(2) Date: Sep. 12, 2022

(87) PCT Pub. No.: WO2021/198420
PCT Pub. Date: Oct. 7, 2021

(65) Prior Publication Data

US 2023/0108871 A1 Apr. 6, 2023

(30) Foreign Application Priority Data

Apr. 3, 2020 (JP) ..... 2020-067576

(51) Int. Cl.
*C10M 173/02* (2006.01)
*C10N 30/06* (2006.01)

(52) U.S. Cl.
CPC ..... *C10M 173/02* (2013.01); *C10M 2201/02* (2013.01); *C10M 2201/062* (2013.01); *C10N 2030/06* (2013.01)

(58) Field of Classification Search
CPC ..... C10M 173/02; C10M 2201/02; C10M 2201/062; C10M 2207/0225; C10M 2207/126; C10M 2207/127; C10M 2223/047; C10M 173/00; C10N 2030/06; C10N 2030/02; C10N 2040/08
See application file for complete search history.

(56) References Cited

U.S. PATENT DOCUMENTS

| | | | | |
|---|---|---|---|---|
| 3,992,312 | A * | 11/1976 | Genjida | C10M 173/02 252/77 |
| 4,493,777 | A * | 1/1985 | Snyder, Jr. | C10M 145/14 508/471 |
| 5,922,657 | A | 7/1999 | Camenzind et al. | |
| 8,299,006 | B2 | 10/2012 | Tagawa et al. | |
| 9,695,380 | B2 | 7/2017 | Greaves | |

FOREIGN PATENT DOCUMENTS

| | | | |
|---|---|---|---|
| CN | 101173197 | A | 5/2008 |
| CN | 104073333 | A | 10/2014 |
| JP | H06279780 | A | 10/1994 |
| JP | H07233391 | A | 9/1995 |
| JP | 2646308 | B2 | 8/1997 |
| JP | 2001107075 | A | 4/2001 |
| JP | 3233490 | B2 | 11/2001 |
| JP | 2007246684 | A | 9/2007 |
| JP | 2008013677 | A | 1/2008 |
| JP | 2014051650 | A | 3/2014 |
| JP | 2015025114 | A | 2/2015 |
| JP | 2016050217 | A | 4/2016 |

OTHER PUBLICATIONS

International Search Report and Written Opinion received for PCT Patent Application No. PCT/EP2021/058615, dated Jul. 9, 2021, 10 pages.
Office Action Received for Chinese Application No. 202180026607.5, dated Feb. 6, 2023, 12 Pages (8 Pages of English Translation and 4 Pages of Official Copy).
Johnson et al.,"Fatty Acids in Industry-processes, Properties, Derivatives, Applications", China Light Industry Press, Feb. 28, 1992, 2 Pages.
Office Action Received for Japanese Application No. 2020-067576, dated Jan. 23, 2024, 07 Pages(03 Pages of English Translation and 04 Pages of Official Copy).

* cited by examiner

*Primary Examiner* — Cephia D Toomer
(74) *Attorney, Agent, or Firm* — SHELL USA, INC.

(57) ABSTRACT

The present invention provides a water/glycol-based hydraulic fluid that includes a total fatty acid and dimer acid of more than 0.4 and no more than 1.2 mass % as a fatty acid lubricant, and also a phosphate ester at between 0.01 and 0.07 mass %. The phosphate ester has the following structure (1) here R1 and R2 each represent a hydrogen atom or a hydrogen group with a carbon number between 1 and 30, and may either be mutually identical or mutually different; $R_3$ represents a hydrocarbon group with a carbon number between 1 and 20; $R_4$ represents a hydrogen atom or a hydrocarbon group with a carbon number between 1 and 30; and $X_1$, $X_2$, $X_3$, and $X_4$ each indicate an oxygen atom or a sulfur atom, where these may either be mutually identical or mutually different.

(1)

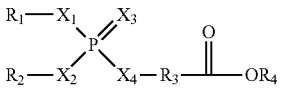

3 Claims, No Drawings

WATER/GLYCOL-BASED HYDRAULIC FLUID

CROSS REFERENCE TO RELATED APPLICATIONS

This is a National stage application of International application No PCT/EP2021/058615, filed 1 Apr. 2021, which claims priority of JP application No. 2020-067576, filed 3 Apr. 2020 which is incorporated herein by reference in its entirety.

FIELD OF THE INVENTION

The present invention relates to an improvement to a water/glycol-based hydraulic fluid.

BACKGROUND OF THE INVENTION

Not only is hydraulic equipment used broadly in industry, contributing to productivity, but it has also been adopted broadly in society in general. Hydraulic fluid is used as the medium for transmitting power in these hydraulic devices, where typically a petroleum-based hydraulic fluid that uses a mineral oil-based base oil, such as a highly refined paraffin-based base oil, is used as the hydraulic fluid.

However, in machine equipment such as iron manufacturing or steel manufacturing equipment in the steel industry, various types of hydraulic equipment die casting machines, forging presses, and the like, where fire prevention is necessary, and in hydraulic equipment in entertainment devices, stage equipment, and the like, in indoor facilities that must emphasize fire safety, petroleum-based hydraulic fluids cannot be used, but rather water/glycol-based hydraulic fluids, which are fluids that include flame retardant water, are used.

When such a water/glycol-based hydraulic fluid, which is a fluid that includes water, is used, it is important that the hydraulic actuation be carried out smoothly and that a long service life be achieved for the hydraulic equipment, and because of this, it is necessary to have good wear resistance and lubricity.

There are known water-including hydraulic compositions that include, for example, a polyoxyethylene alkylene glycol diether compound, a polyoxyalkylene glycol monoether compound, a polyoxypropylene glycol monoether compound, and a fatty acid salt, of a specific structure, in water, in order to cause an improvement in the lubricity and the wear resistance performance in the water/glycol-based hydraulic fluid, for example in JP3233490.

Moreover, the inclusion of a small amount of a neutralization product of a base and glycerol borate, which is produced through reacting, for example, boric anhydride or boron trichloride, in a water/glycol-based hydraulic fluid is known in JP 2646308.

Moreover, the inclusion of a water-soluble polyether of a specific structure that is derived from water-soluble polyoxyalkylene polyols and glycidyl ether in a water/glycol-based hydraulic fluid is also known from JP H7-233391.

SUMMARY OF THE INVENTION

The present invention produces a high-performance water/glycol-based hydraulic fluid through greatly improving the durability to wear thereof, without any negative effect whatsoever on various types of performance of water/glycol-based hydraulic fluids, through mixing specific additives into the water/glycol-based hydraulic fluid.

The water/glycol-based hydraulic fluid of the invention includes, in a total of 100 mass %, water at between 20 and 60 mass %, glycols at between 20 and 60 mass %, and a fatty acid-based lubricant, an alkali hydroxide compound, a thickening agent, a rust inhibiting agent, a corrosion inhibiting agent, a defoaming agent, and the like. During the research and development carried out by the present inventors for the purpose of improving the performance of water/glycol-based hydraulic fluids, as described above, it was discovered that it is possible to greatly improve the wear resistance of a water/glycol-based hydraulic fluid through the use of both dimer acid and lauric acid as fatty acid lubricants, together with inclusion of an ester phosphate of a specific structure, and the present invention was created based on this knowledge.

That is, the present invention is a water/glycol-based hydraulic fluid that includes a total dimer acid and fatty acid of more than 0.4 mass % and no more than 1.2 mass %, and also a phosphate ester, where the phosphate ester has the following structure (1):

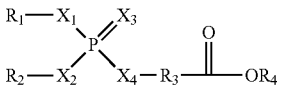

(1)

where $R_1$ and $R_2$ each represent a hydrogen atom or a hydrogen group with a carbon number between 1 and 30, and may either be mutually identical or mutually different; $R_3$ represents a hydrocarbon group with a carbon number between 1 and 20; $R_4$ represents a hydrogen atom or a hydrocarbon group with a carbon number between 1 and 30; and $X_1$, $X_2$, $X_3$, and X4 each indicate an oxygen atom or a sulfur atom, where these may either be mutually identical or mutually different.

DETAILED DESCRIPTION OF THE INVENTION

The present invention enables easy production of a water/glycol-based hydraulic fluid with good convenience, with greatly improved wear resistance, without any negative effect whatsoever on various types of performance of water/glycol-based hydraulic fluids, through mixing in a small amount of the specific additives described above.

A fatty acid lubricant is used in the water/glycol-based hydraulic fluid according to the present invention. The fatty acid lubricant may be, for example, capric acid, undecyl acid, lauric acid, tridecyl, myristic acid, pentadecyl acid, palmitic acid, margaric acid, stearic acid, or another saturated fatty acid, oleic acid, linoleic acid, linolenic acid, or another unsaturated fatty acid, or the like. Moreover, dimer acid, which is a dimer of unsaturated fatty acids with 18 carbons, is also included. A dimer acid is a liquid fatty acid that includes monobasic acids and tribasic acids, and has, as its main component, a dibasic C36 dicarboxylic acid produced through dimerization of a C18 unsaturated fatty acid that has, as the source material thereof, a vegetable oil or fat.

The fatty acid and dimer acid are included in total at more than 0.4 mass % and no more than 1.2 mass % in respect to the totality of the composition of the water/glycol-based hydraulic fluid, and preferably at between 0.6 and 1.1 mass %, and more preferably at between 0.8 and 1.0 mass %.

If the inclusion proportion described above were less than 0.4 mass %, it would not be possible to produce adequate wear resistance, while, on the other hand, if in excess of 1.2 mass %, there would be a tendency to produce sludge, which would be undesirable.

Moreover, although the fatty acids described above normally use the form of acids, that which has been formed into a sodium salt may be used as well, and both of the above may be mixed for use as appropriate.

Additionally, a phosphate ester is included in this water/glycol-based hydraulic fluid.

The phosphate ester is represented by the following general formula (1):

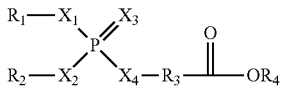

(1)

In this general formula, $R_1$ and $R_2$ are each a hydrogen atom or a hydrocarbon group with a carbon number between 1 and 30, where $R_1$ and $R_2$ may be mutually identical or may be mutually different.

$R_3$ in the above represents a hydrocarbon group with a carbon number between 1 and 20. $R_4$ represents a hydrogen atom or a hydrocarbon group with a carbon number between 1 and 30. $X_1$, $X_2$, $X_3$, and $X_4$ are each an oxygen atom or a sulfur atom, and may be mutually identical or may be mutually different.

This phosphate ester is included at between 0.01 and 0.07 mass %, in respect to the totality of the water/glycol-based hydraulic composition, but preferably uses between 0.01 and 0.05 mass %, and more preferably between 0.015 and 0.03 mass %.

If the inclusion proportion were less than 0.01 mass %, the effect of adding to produce adequate wear resistance would not be produced, which would be undesirable.

The glycol may be, for example, ethylene glycol, propylene glycol, butylene glycol, hexylene glycol, diethylene glycol, dipropylene glycol, dibutylene glycol, dihexylene glycol, trimethylene glycol, triethylene glycol, tripropylene glycol, or the like.

The glycol may either be used in a single variety alone, or two or more types may be mixed for use. Preferably, propylene glycol or dipropylene glycol is used. This glycol is used at between 20 and 60 mass %, in respect to the totality of the water/glycol-based hydraulic fluid composition, and more preferably used at between 30 and 50 mass %.

An alkanolamine may be used as a rust inhibiting agent. The alkanolamines may be, for example, methanolamine, ethanolamine, propanolamine, diethanolamine, triethanolamine, dimethylethanolamine, N-methylethanolamine, N-methyldiethanolamine, N,N-dimethylaminoethanol, N,N-diethylaminoethanol, N,N-dipropylaminoethanol, N,N-dibutylaminoethanol, N,N-dipentylaminoethanol, N,N-dihexylaminoethanol, N,N-diheptylaminoethanol, N,N-dioctylaminoethanol, or the like. This alkanolamine is included at between 1.0 and 5.0 mass % in respect to the total composition.

The alkali hydroxide compound is potassium hydroxide or sodium hydroxide, where either of these may be used singly, or, as appropriate, both may be used together. The alkali hydroxide is included at between 0.01 and 0.12 mass % in respect to the total composition, and more preferably included at between 0.04 and 0.06 mass %.

Moreover, as necessary, publicly known additives, for example, thickening agents, lubricating agents, metal stabilizing agents, wear inhibiting agents, extreme pressure agents, dispersing agents, metal-based cleaning agents, friction adjusting agents, corrosion inhibiting agents, anti-emulsifying agents, defoaming agents, and other various types of additives may be mixed, either singly or in combinations thereof, into such a water/glycol-based hydraulic fluid. In this case, an additive package for the water/glycol-based hydraulic fluid may be used.

EXAMPLES

The water/glycol-based hydraulic fluid according to the present invention will be explained in detail below, citing embodiments and reference examples; however, the present invention is in no way limited thereby.

Water/glycol-based hydraulic fluids of Examples 1 through 3 were produced through mixing the various components based on the blending quantities given in Table 1.

Example 1

A water/glycol-based hydraulic fluid was produced through the use of 0.400 mass % dimer acid, 0.400 mass % lauric acid as a fatty acid, 0.015 mass % 3-(di-isobutoxy-thiophosphorylsulfanyl)-2-methyl-propionic acid as a phosphate ester (A), 38.628 mass % propylene glycol as the glycol, 16.10 mass % water soluble polymer as a thickening agent, 2.565 mass % total inclusion of sodium hydroxide, corrosion inhibiting agents, defoaming agents, and the like, as other additives, and 41.892 mass % water, and mixing thoroughly. The water/glycol-based hydraulic fluid had a preliminary alkalinity, produced through JIS K 2234-1994, of 20, a 40° C. kinematic viscosity of 46 $mm^2$/sec, and a pH of 11.

The phosphate ester (A) used in Example 1, set forth above, is that which is represented by the following structural formula:

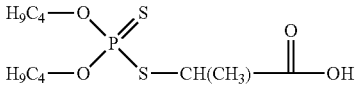

Example 2

A water/glycol-based hydraulic fluid was produced through the use of 0.400 mass % dimer acid, 0.400 mass % lauric acid as a fatty acid, 0.015 mass % ethyl-3(bis(1-methyl ethoxy)phosphinothioyl)-thiol)propionate acid as a phosphate ester (B), 38.628 mass % glycol, 16.10 mass % thickening agent, 2.565 mass % other additives, and 41.892 mass % water, and mixing thoroughly. The water/glycol-based hydraulic fluid had a preliminary alkalinity, produced through JIS K 2234-1994, of 20, and a 40° C. kinematic viscosity of 46 $mm^2$/sec.

The phosphate ester (B) used in Example 2, set forth above, is that which is represented by the following structural formula (in which R is an ethyl group).

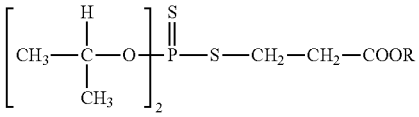

Example 3

A water/glycol-based hydraulic fluid was produced through the use of 0.400 mass % dimer acid, 0.400 mass % lauric acid as a fatty acid, 0.030 mass % phosphate ester (B), 38.628 mass % glycol, 16.10 mass % thickening agent, 2.565 mass % other additives, and 41.877 mass % water, and mixing thoroughly. The preliminary alkalinity produced through JIS K 2234-1994 was 20, with a 40° C. kinematic viscosity of 46 $mm^2$/sec.

Comparative Examples 1 to 5

Water/glycol-based hydraulic fluids were produced in the same manner as in the embodiments set forth above through mixing various components based on the blending quantities given in Table 2. The water/glycol-based hydraulic fluids of Comparative Examples 1 through 5 all had preliminary alkalinities, produced through JIS K 2234-1994, of 20, and 40° C. kinematic viscosities of 46 $mm^2$/sec.

Testing

The following tests were carried out in order to evaluate the wear resistance and lubricity for the Examples and Comparative Examples set forth above.

Shell Four Ball Test

Based on ASTM D4172, the operation was carried out for 30 minutes at room temperature with a load of 40 kgf with a primary axle rotational speed up 1500 rpm, and the wear scar diameters (mm) on the steel balls after testing were measured.

Evaluation Standards:

Wear scar diameter<0.65 mm: Pass (O)

Wear scar diameter>0.65 mm: Fail (x)

Test Results

The test results are presented in Tables 1 and 2.

TABLE 1

| | Example 1 | Example 2 | Example 3 |
|---|---|---|---|
| Dimer Acid | 0.400 | 0.400 | 0.400 |
| Lauric Acid | 0.400 | 0.400 | 0.400 |
| Phosphate Ester (A) | 0.015 | | |
| Phosphate Ester (B) | | 0.015 | 0.030 |
| Glycol | 38.628 | 38.628 | 38.628 |
| Thickening Agent | 16.100 | 16.100 | 16.100 |
| Other Additives | 2.565 | 2.565 | 2.565 |
| Water | 41.892 | 41.892 | 41.877 |
| Wear Scar Diameter (mm) | 0.47 ○ | 0.57 ○ | 0.52 ○ |

As can be appreciated from Table 1, in Example 1 wherein 0.40 mass % dimer acid and 0.40 mass % lauric acid were used together (for a total of 0.80 mass %), and 0.015 mass % phosphate ester (A) was used, the wear scar diameter after the shell four ball test was completed was small, at 0.47 mm, indicating excellent wear resistance and lubricity.

In Example 2, the same amount of phosphate ester (B) was used instead of the phosphate ester (A) of Example 1, and the wear scar diameter was 0.57 mm; this result was also good. In Example 3, the inclusion proportion of the phosphate ester (B) was doubled when compared to Example 2, and the wear scar diameter improved to 0.52 mm.

TABLE 2

| | Comp. Example 1 | Comp. Example 2 | Comp Example 3 | Comp. Example 4 | Comp. Example 5 |
|---|---|---|---|---|---|
| Dimer Acid | 0.400 | 0.200 | 0.200 | 0.400 | |
| Lauric Acid | 0.400 | 0.200 | 0.200 | | 0.400 |
| Phosphate Ester (A) | | 0.015 | 0.030 | 0.050 | 0.050 |
| Glycol | 38.628 | 38.628 | 38.628 | 38.628 | 38.628 |
| Thickening Agent | 16.100 | 16.100 | 16.100 | 16.100 | 16.100 |
| Other Additives | 2.565 | 2.565 | 2.565 | 2.565 | 2.565 |
| Water | 41.907 | 42.292 | 42.277 | 42.257 | 42.257 |
| Wear Scar Diameter (mm) | 0.72 X | 0.78 X | 0.85 X | 0.87 X | 0.88 X |

On the other hand, in Comparative Example 1, when there was no phosphate ester, the wear scar diameter after the shell four ball test was completed was 0.72 mm, resulting in a failure, despite using dimer acid and lauric acid.

In Comparative Examples 2 and 3, good effects were not produced when the total amount of dimer acid and lauric acid was low, notwithstanding the inclusion of the phosphate ester.

Moreover, in Comparative Examples 4 and 5, it is understood that good effects are not produced, despite increasing the phosphate ester to 0.05 mass %, if either the dimer acid or the lauric acid is absent.

I claim:

1. A water/glycol-based hydraulic fluid that includes water at between 20 and 60 mass %, between 20 and 60 mass % of glycol, a fatty acid and a dimer acid, wherein the total fatty acid and dimer acid is more than 0.4 mass % and no more than 1.2 mass % as a fatty acid lubricant, and also a phosphate ester represented by the following general formula (1):

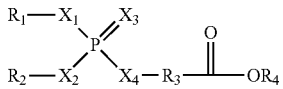

(1)

where $R_1$ and $R_2$ each represent a hydrogen atom or a hydrogen group with a carbon number between 1 and 30, and may either be mutually identical or mutually different; $R_3$ is —CH(CH3)- or —CH2-CH2-; $R_4$ represents a hydrogen atom or a hydrocarbon group with a carbon number between 1 and 30; and wherein $X_1$ and $X_2$ of the phosphate ester are oxygen atoms and $X_3$ and $X_4$ are sulfur atoms.

2. The water/glycol-based hydraulic fluid as set forth in claim 1, wherein: the inclusion proportion of the phosphate ester is between 0.01 and 0.07 mass %.

3. The water/glycol-based hydraulic fluid as set forth in claim 1, wherein: the carbon number of the fatty acid is between 6 and 18.

* * * * *